US005193680A

United States Patent [19]

Schumann et al.

[11] Patent Number: 5,193,680

[45] Date of Patent: Mar. 16, 1993

[54] SLAT BOX FOR WINDOW BLIND STOCK

[75] Inventors: Arthur I. Schumann, Marina Del Rey; Michael J. McCarty, Mission Viejo, both of Calif.

[73] Assignee: 3 Day Blinds, Inc., Anaheim, Calif.

[21] Appl. No.: 897,251

[22] Filed: Jun. 11, 1992

[51] Int. Cl.[5] ..... B65D 85/66

[52] U.S. Cl. ..... 206/394; 206/408; 206/413; 242/58.6

[58] Field of Search ..... 242/55.3, 58.6; 206/391, 393, 394, 397, 53, 54, 408, 413, 389

[56] References Cited

U.S. PATENT DOCUMENTS

| | | | |
|---|---|---|---|
| 2,276,959 | 3/1942 | Goldsmith | 206/391 |
| 2,699,866 | 1/1955 | Russell, Jr. | 206/394 X |
| 2,918,342 | 12/1959 | Tarte, Jr. | 206/393 X |
| 3,281,033 | 10/1966 | Stutzman et al. | 206/394 X |
| 3,730,340 | 5/1973 | Neubert | 206/397 X |
| 4,042,107 | 8/1977 | Kendig | 206/391 X |
| 4,141,447 | 2/1979 | Anderson | 206/408 X |
| 4,392,912 | 7/1983 | Horsley | 242/58.6 X |
| 4,570,794 | 2/1986 | Capitao, Jr. | 206/394 |
| 5,053,811 | 10/1991 | Watabe et al. | 206/397 X |
| 5,096,063 | 3/1992 | Schreiter | 206/391 |

*Primary Examiner*—Jimmy G. Foster
*Assistant Examiner*—Jacob K. Ackun, Jr.
*Attorney, Agent, or Firm*—Stetina and Brunda

[57] ABSTRACT

A slat box for holding two or more slat stock rolls during the fabrication of metal window blinds. The slat box comprises a housing defining a plurality of equally sized adjacent compartments therein. Each of the stock rolls is interfaced to a respective compartment via the receipt of axle members inserted through the stock rolls into corresponding pairs of inserts attached to the side walls and partition members defining the compartments within the housing. The slat box further includes a rod member insertable through the inserts and axle members for preventing the stock rolls from being lifted out their respective compartments. Additionally, brake members are provided which are disposed between the stock rolls and inserts for preventing "free-wheeling" of the stock rolls from occurring.

20 Claims, 3 Drawing Sheets

SLAT BOX FOR WINDOW BLIND STOCK

FIELD OF THE INVENTION

The present invention relates generally to manufacturing equipment, and more particularly to a device for holding multiple rolls of metal window blind slat stock material and allowing such material to be payed out therefrom into a manufacturing machine while preventing the material from "free wheeling" and damage to the edges of the material from occurring.

BACKGROUND OF THE INVENTION

As is well known, metal window blinds more commonly known as mini-blinds and/or venetian blinds generally comprise a plurality of elongate, horizontally oriented slats which are fabricated from aluminum stock. The aluminum slat stock material is typically provided in the form of relatively large diameter aluminum slat stock rolls. During the manufacturing process, one or more rolls of the slat stock material are disposed adjacent a crowning unit which is utilized to crown the slat stock as well as out the same to a desired length. Typically, the slat stock is fed directly from the stock roll into the crowning unit wherein the diameter of the roll continuously decreases as more material is payed out from the stock roll and fed into the crowning unit.

In the prior art, it is known to place one or more rolls of slat stock material on feeding fixtures which generally comprise a base member having two or more roller members attached thereto wherein the roller members are separated in a manner adapted to support the roll of slat stock material thereon. As the material is fed into the crowning unit, the entire roll rotates upon the roller members. Though these types of feeding devices are generally suitable for feeding slat stock material into a crowning unit, these devices possess certain deficiencies which detract from their overall utility.

Particularly, such devices do not include an axle or similar structure which extends through the center of the slat stock roll or rolls disposed thereon. Rather, as previously specified, the stock rolls merely rest upon the roller members and therefore are retained on the roller members only by their weight. In this respect, as the weight of the roll decreases as more material is payed out and fed into the crowning unit, often times an abrupt pulling of additional material into the crowing unit will cause the roll to lift off the support rollers. Additionally, in such prior art feeding devices no braking force is applied to the roll while material is being payed out therefrom. This lack of an applied braking force often causes "free-wheeling" to occur wherein additional slat material is fed out from the roll though no additional material is being introduced into the crowning unit. Finally, these prior art feeding devices provide no protection or barriers between multiple rolls which may be stored thereon and thus do not protect the edges of the slat material from damage. The present invention overcomes these and other deficiencies associated with prior art slat stock material feeding devices.

SUMMARY OF THE INVENTION

In accordance with a preferred embodiment of the present invention, there is provided a slat box for holding one or more rolls of slat stock material during the fabrication of window blinds. The slat box generally comprises a housing having front and back walls, a right side wall and a left side wall. Disposed within the housing and extending between the front wall and back wall is at least one partition member which forms first and second adjacent compartments within the housing. The compartments are preferably of substantially uniform width and are each sized and configured to receive a stock roll. In the preferred embodiment, the slat box includes three partition members disposed within the housing which define four interior compartments of substantially equal width for receiving four slat stock rolls.

Attached to the right side wall of the housing is a right insert, while attached to the left side wall of the housing is a left insert. Additionally, attached to each of the partition members is a central insert. In the preferred embodiment, the right, left and central inserts are horizontally aligned when disposed within the housing. Received into each of the compartments defined within the housing is a stock roll which is connected to a corresponding pair of inserts, i.e. the right insert and an adjacent central insert, the left insert and an adjacent central insert, and pairs of adjacent central inserts. Additionally, the right side wall, left side wall and partition members are identically configured and include notches disposed therein for slidably receiving a respective one of the inserts.

Each of the stock rolls preferably includes an axle member inserted thereinto for facilitating the connection of each stock roll to a respective pair of inserts. Each axle member is slidably interfaced to an insert pair with the hub of the stock roll being rotatable about the outer surface of the axle member. In the preferred embodiment, the right and left inserts are identically configured and define a pair of opposed, vertically oriented slots which are sized and configured to slidably receive the opposed vertical edges of the notches disposed in the right and left side walls. The right and left inserts further include a recess sized and configured to receive one end of an axle member inserted into a stock roll. Like the right and left inserts, each of the central inserts define a pair of opposed, vertically oriented slots which are sized and configured to slideably receive the opposed vertical edges of the notches disposed in the partition members. The central inserts further include a recess disposed in each of the opposed planer faces thereof which are sized and configured to receive the ends of the axle members opposite those connected to the right or left inserts or an adjacent central insert.

Each of the axle members preferably has a generally cylindrical configuration and defines first and second ends for receipt into the recesses of a respective pair of inserts. Additionally, the first end preferably includes an annular shoulder formed thereabout. Disposed about the first end of each axle member is a first brake member which is compressed between the shoulder and the stock roll when the axle member is fully inserted into the stock roll. Disposed about the second end of each axle member between the stock roll and the particular insert into which the second end is inserted is a second brake member. The first and second brake members are preferably fabricated from rubber and used to prevent the stock roll form "free-wheeling" and to prevent damage to the edges of the slat material from occurring when such is payed out from the slat box. Advantageously, each of the recesses formed in the right, left and central inserts is configured to accommodate the shoulder of an axle member.

In the preferred embodiment, each of the inserts and axle members include apertures extending therethrough which are in substantial axial alignment when the inserts are received into the notches and the axle members connected to the inserts. The coaxially aligned apertures are preferably sized to receive an elongate rod member, the opposed ends of which are adapted to be securable to the left and right inserts. As will be recognized, the rod member extends through the centers of each of the stock rolls received into the compartments thereby preventing the rolls from lifting off of the slat box.

To further prevent damage to the edges of the slat material, the slat box of the present invention is provided with a plurality of liner members which are attached to the right and left side walls as well as the partition members in a manner wherein the liner members are disposed within the compartments defined within the housing. The liner members preferably comprise nylon sheets and are sized to prevent contact between the edges of the stock rolls and the right and left side walls and partition members when the stock rolls are rotated within the compartments.

In the preferred embodiment, the front wall of the housing defines a top edge and is formed having a height such that the top edge is oriented below the inserts. As will be recognized, the height of the front wall is specifically sized so as not to interfere with the paying out of material from the stock rolls. Additionally, the housing is preferably provided with roller casters attached to the bottom thereof to facilitate the movement of the slat box to different crowning units. The housing and partition members are preferably fabricated from wood with the inserts and axle members preferably being fabricated from nylon though delrin may be utilized as an alternative.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
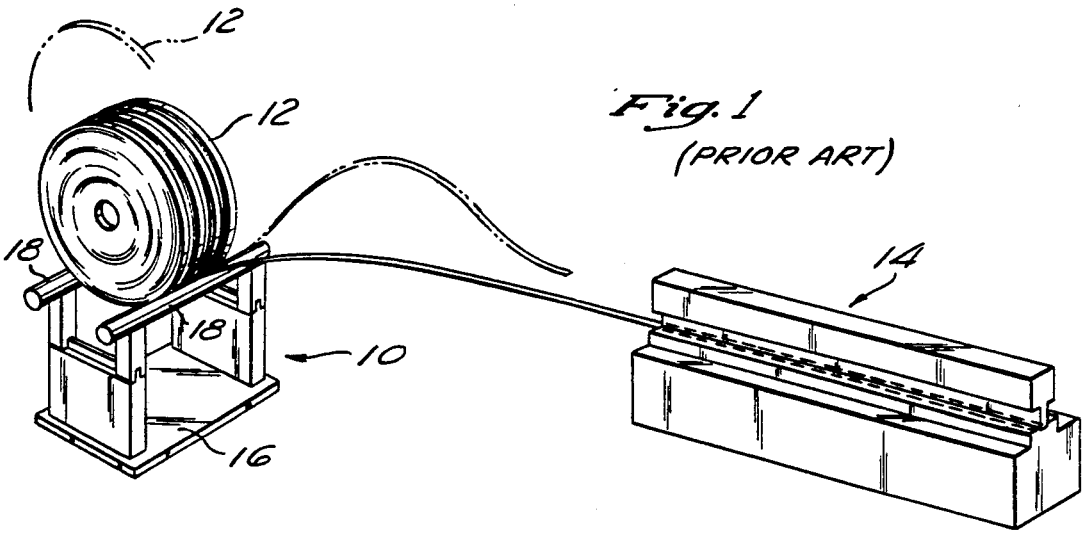
Fig. 1 (PRIOR ART)
FIG. 1 is a perspective view of a prior art slat material feeding device illustrating the manner in which the material is introduced into a machine such as a crowning unit.

Referring now to the drawings wherein the showings are for purposes of illustrating a preferred embodiment of the present invention only, and not for purposes of limiting the same, FIG. 1 perspectively illustrates a slat stock feeding device 10 constructed in accordance with the prior art. The prior art feeding device 10 is utilized to hold one or more slat stock material rolls 12 for purposes of feeding the slat material into a manufacturing machine such as a crowning unit 14. The prior art feeding device 10 comprises a base member 16 having a pair of roller members 20 attached thereto in parallel, spaced relation. The roller members 18 are adapted to support the stock rolls 12 and allow the same to rotate thereupon during the paying out of slat material into the crowning unit 14. Typically, as the rolls 12 gets smaller as stock is payed out therefrom, the roller members 18 move inwardly toward one another to prevent the decreased diameter rolls 12 from falling therebetween.

Though the prior art feeding device 10 generally serves the purpose of providing support for a stock roll 12 and allowing slat material to be fed into the crowning unit 14, the feeding device 10 includes no axle or similar structure extending through the center of the stock rolls 12 to prevent the same from lifting off the feeding device 10. Additionally, the feeding device 10 includes no braking device which prevents "free-wheeling" of the slat material from occurring (shown in phantom) when such material is being fed into the crowning unit 14. Further, the prior art feeding device 10 includes no structures which are adapted to prevent the rolls 12 from contacting one another so as to prevent damage to the edges of the slat material from occurring.

Figure 2:
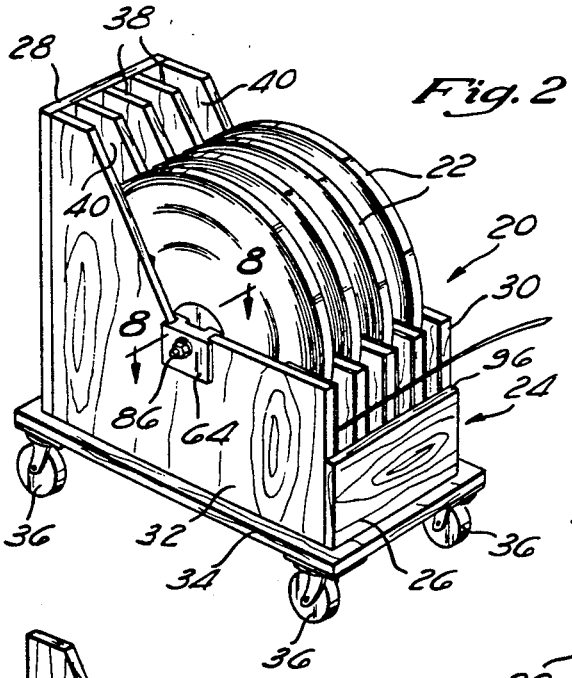
FIG. 2 is a perspective view of the slat box of the present invention.

Referring now to FIG. 2, in recognition of the deficiencies associated with the prior art slat stock material feeding device 10, there is provided the slat box 20 constructed in accordance with the preferred embodiment of the present invention. Slat box 20 as hereinafter described is adapted to simultaneously, rotatably support four slat stock material rolls 22, though it will be recognized that the slat box 20 may be configured to accommodate greater or lesser numbers of stock rolls 22. In the preferred embodiment, slat box 20 generally comprises a housing 24 having a front wall 26, a back wall 28, a right side wall 30 and a left side wall 32. The right side wall 30 and left side wall 32 are identically configured, with the front wall 26 being fabricated at a height significantly less than the height of the back wall 28, for reasons which will be described below. The front wall 26, back wall 28, right side wall 30 and left side wall 32 are supported upon a base member 34 having a generally rectangular configuration. Attached to the bottom surface of the base member 34 are a plurality of roller casters 36 which are utilized to allow the housing 24 to be selectively positioned adjacent a metal window blind manufacturing machine such as the crowning unit 14 previously described.

Figure 3:
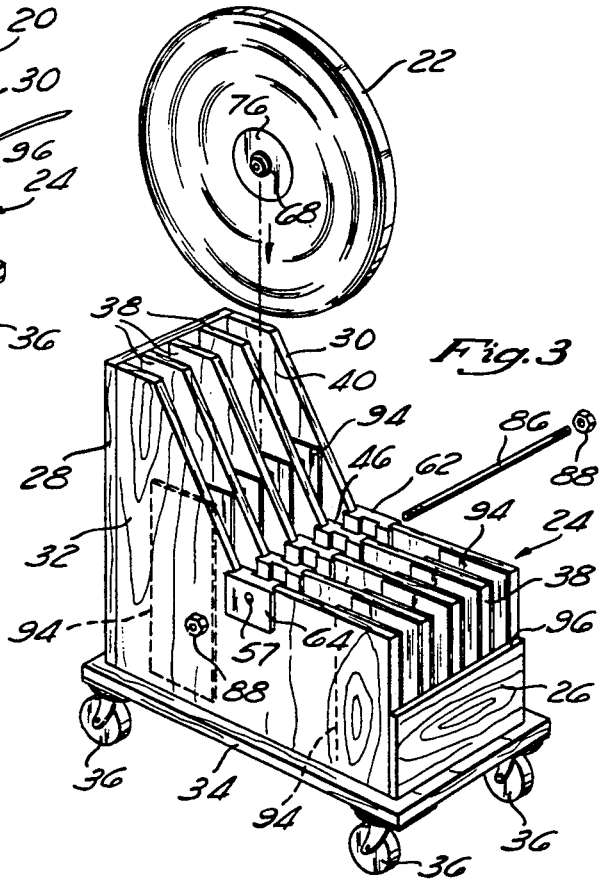
FIG. 3 is an exploded view illustrating the manner in which a slat stock roll and retaining rod are interfaced to the slat box.
Figure 4:
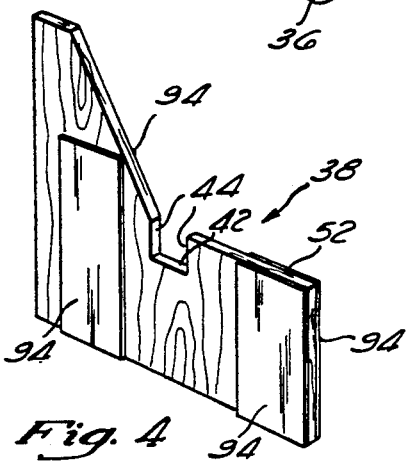
FIG. 4 is a perspective view of one of the partition members used to define the compartments within the slat box housing.

Referring now to FIGS. 2–4, disposed within the housing 24 and extending between the front wall 26 and back wall 28 thereof are a plurality of identically configured partition members 38. Each of the partition members 38 extends perpendicularly between the front wall 26 and back wall 28 and are identically configured to the right side wall 30 and left side wall 32 of the housing 24. In the preferred embodiment, three partition members 28 are disposed within the housing 24 thus forming four adjacent compartments 40 within the housing 24, each of which are specifically sized to accommodate a slat stock roll 22. As previously indicated, the housing 24 may be sized to accommodate greater or lesser numbers of partition members 38 and thus more or less than four (4) slat stock rolls 22.

Figure 6:
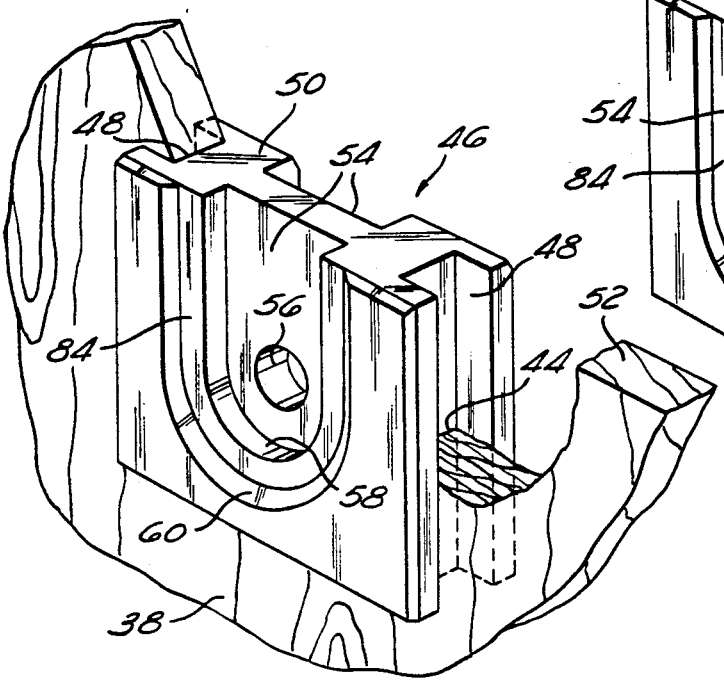
FIG. 6 is a partial perspective view illustrating the manner in which the central insert shown in FIG. 5 is interfaced to the partition member shown in FIG. 4.
Figure 5:
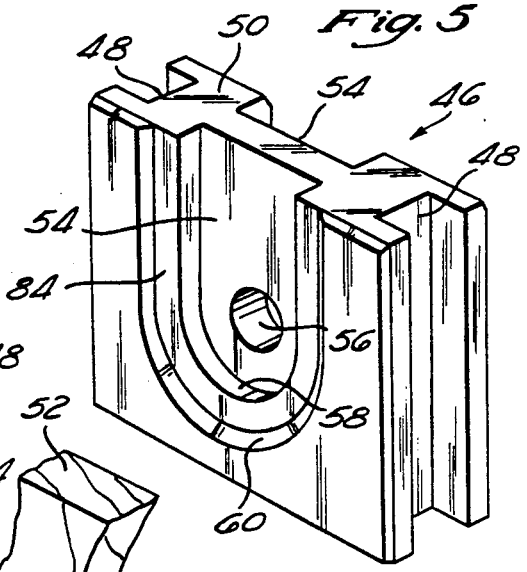
FIG. 5 is a perspective view of a central insert used in the present invention.

Disposed in each of the partition members 38, as well as the right side wall 30 and left side wall 32, is a generally square notch 42 defining opposed vertical edges 44. Referring now to FIGS. 3, 5 and 6, attached to each of the partition members 38 are identically configured central inserts 46. Each of the central inserts 46 defines a pair of vertically oriented slots 48, with the central inserts 46 being slideably received into a respective one of the notches 42 disposed within the partition members 38 via the slidable receipt of the opposed vertical edges 44 into the vertical slots 48. Importantly, the height of each of the central inserts 46 is substantially equal to the height of the opposed vertical edges 44. As such, when the central inserts 46 are fully received into a respective notch 42, the top surfaces 50 of the central inserts 46 will be substantially coplaner with the top, horizontal edges 52 of the partition members 38. Disposed in opposed planar faces of each of the central inserts 46 are identically configured recesses 54, while extending laterally through each of the central inserts 46 between the recesses 54 are apertures 56, the use of which will be explained below. In the preferred embodiment, each of the recesses 54 extends downwardly from the top surface 50 and has a stepped configuration which defines an inner arcuate surface 58 and an outer, angled arcuate surface 60.

Figure 8:
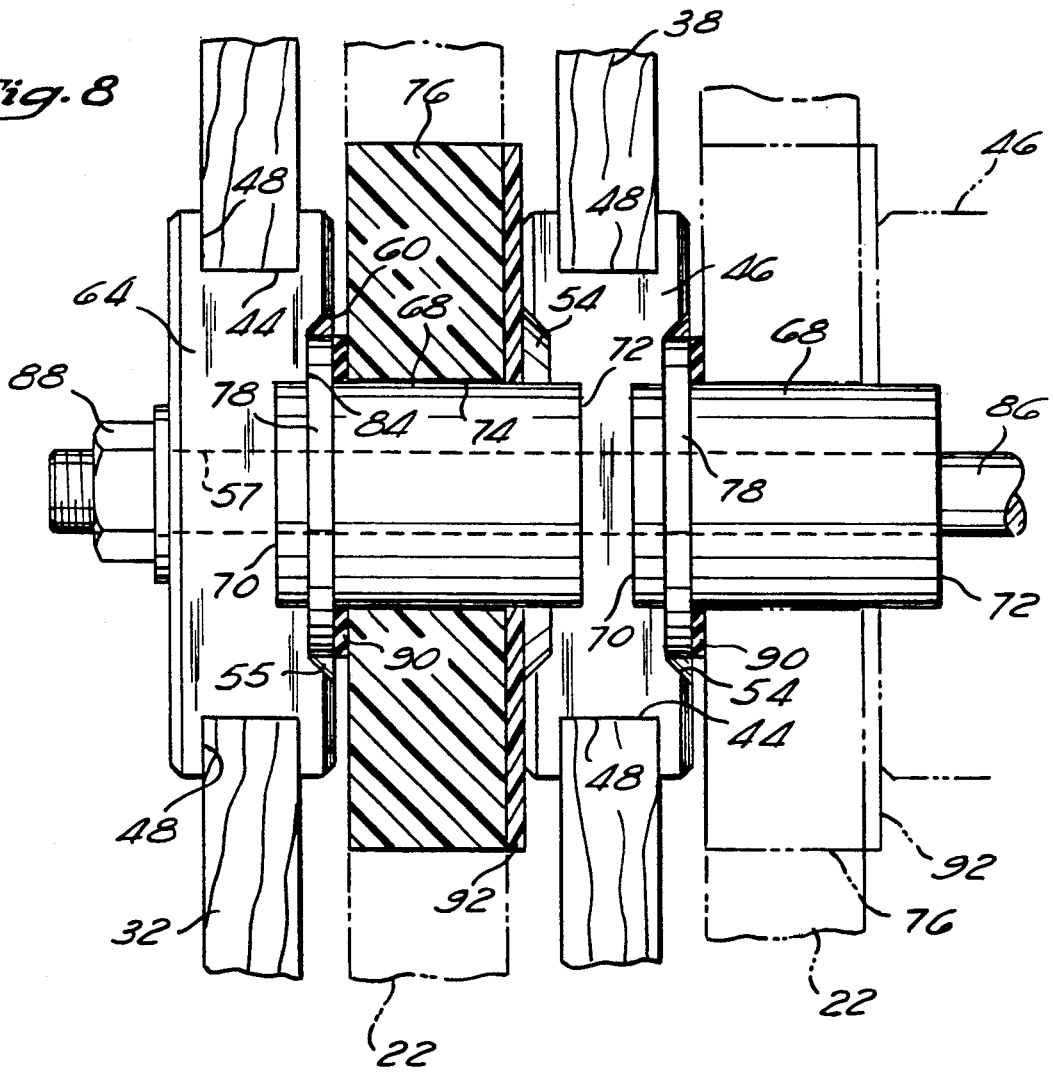
FIG. 8, is a cross-sectional view taken along line 8—8 of FIG. 2.

Referring now to FIGS. 2, 3, and 8, attached to the right side wall 30 is a right insert 62 while attached to the left side wall 32 is a left insert 64. In the preferred embodiment, the right insert 62 and left insert 64 are identically configured and substantially similar in shape to the central inserts 46, except that both the right insert 62 and left insert 64 include a recess 55, which is identical to the recesses 54, disposed in only one of the opposed planar faces thereof. As such, the planar faces 66 of right insert 62 and left insert 64 opposite those into which the recesses 55 are included, are substantially continuous. Extending laterally through the right insert 62 and left insert 64 between the interior of a respective recess 55 and a respective side surface 66 are apertures 57. Similar to the manner in which the central inserts 46 are interfaced to the partition members 38, the right insert 62 is slideably received into the notch 42 disposed within the right side wall 30 via the slidable receipt of the opposed vertical edges 44 of the notch 42 into the vertical slots 48 of the right insert 62. The left insert 64 is received into the notch 42 disposed in the left side wall 32 via the receipt of the opposed vertical edges 44 into the vertical slots 48 of the left insert 64. Importantly, the right insert 62 is attached to the right side wall 30 such that the recess 55 disposed therein faces inwardly toward the adjacent partition member 38. Additionally, the left insert 64 is attached to the left side wall 32 such that the recess 55 therein faces inwardly toward the adjacent partition member 38.

Figure 7:
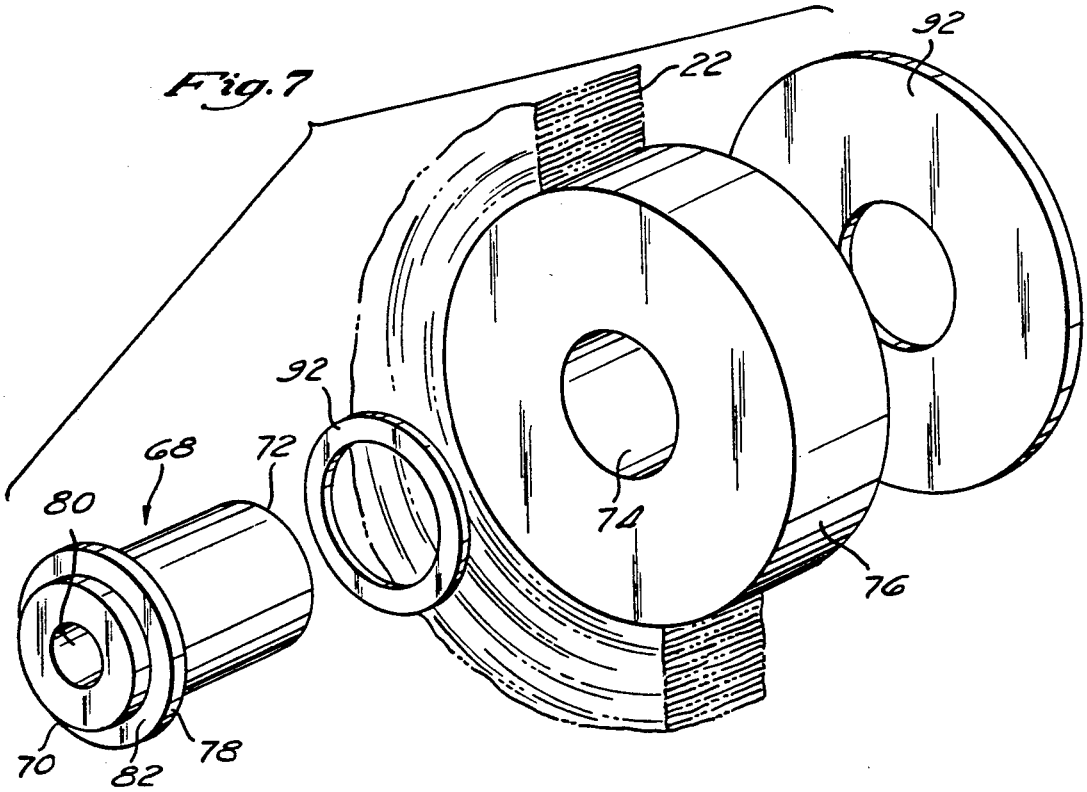
FIG. 7 is an exploded view illustrating the manner in which an axle member and first and second brake members are interfaced to a slat stock roll.

Referring now to FIGS. 7 and 8, inserted into each of the stock rolls 22 is a generally cylindrical axle member 68 which is used to facilitate the connection of the stock roll 22 to a respective pair of the inserts attached to the housing 24. Each axle member 68 defines a first end 70 and a second end 72 which is inserted into a correspondingly shaped aperture 74 disposed within a hub portion 76 of each stock roll 22. Formed adjacent the first end 70 of the axle member 68 is an annular shoulder 78. Additionally, disposed within and extending axially through the axle member 68 is an aperture 80. As best seen in FIG. 8, the axle member 68 is sized such that when fully inserted into the hub portion 76, the second end 72 protrudes outwardly therefrom.

In the preferred embodiment, each of the slat stock rolls 22 is connected to a respective pair of inserts attached to the housing 24, i.e. one roll 22 between the right insert 62 and an adjacent central insert 46, one roll between the left insert 64 and an adjacent central insert 46, and two rolls between adjacent pairs of central inserts 46. The connection of the rolls 22 to the inserts is facilitated by the axle members 68. In this respect, as seen in FIG. 8, the first end 70 of each axle member 68 is slidably received into the recesses 54, 55 of a one of the insert pairs with the second end 72 being received into the recesses 54, 55 of the insert directly adjacent that into which the first end 70 is inserted. Importantly, each of the recesses 54, 55 is configured to accommodate either the first end 70 and shoulder 78 formed thereabout or the second end 72. As such, the connection of the stock roll 22 to a pair of inserts may occur irrespective of the orientation of the axle member 68 within the hub 76.

When fully received into a respective pair of inserts, the first end 70 of the axle member 68 is abutted against the correspondingly shaped inner arcuate surface 58 of the recesses 54, 55. Additionally, the outer surface 82 of the shoulder 78 is in abutting contact with the interior surface 84 of the recesses 54, 55 adjacent the outer angled arcuate surface 60. The second end 72 of the axle member 68 is also abutted against the inner arcuate surface 58 of the corresponding insert of the insert pair. Slat material is payed out from the roll member 22 via the rotation of the hub 76 about the cylindrical outer surface of the axle member 68.

In the preferred embodiment, when the axle members 68 are received into a respective pair of inserts, the apertures 57 within the left insert 64 and right insert 62, the apertures 56 within the central inserts 46, and the apertures 80 within the axle members 68, are in substantial axial alignment. As seen in FIGS. 2 and 3, the coaxially aligned apertures 56, 57 and 80 are sized to receive an elongate rod member 86. The opposed ends of the rod member 86 are prefereably threaded and securable to the right insert 62 and left insert 64 via fasteners such as bolts 88 for purposes of maintaining the rod member 86 within the apertures 56, 57 and 80. Importantly, the rod member 86 prevents any of the stock rolls 22 from lifting out of a respective compartment 40 when slat material is being payed out therefrom.

Disposed about the first end 70 of each axle member 68 is a first brake member 90 which is compressed between the inner surface of the annular shoulder 78 and the hub portion 76 of the roll member 22 when the axle member 68 is fully inserted into the aperture 80. Additionally, disposed about the second end 72 of each axle member 68 between the hub portion 76 and the insert to which the second end 72 is connected is a second brake member 92. In the preferred embodiment, the first brake member 90 has an outer diameter roughly equal to the outer diameter of the shoulder 78, while the second brake member 92 has an outer diameter roughly equal to the outer diameter of the hub portion 76. When the second end 72 of an axle member 68 is connected to a insert, the second brake member 92 is directly abutted against both the hub portion 76 and the insert to which the second end 72 is connected.

Importantly, the first brake member 90 and second brake member 92 function to apply a braking force to the stock roll 22 when slat material is being payed out therefrom, thereby controlling the rotational speed of the stock roll 22 to prevent "free-wheeling" from occurring. Additionally, the spacing between the stock rolls 22 and right side wall 30, left side wall 32 and partition members 38 facilitated by the brake members 90, 92 aids in preventing contact of the slat material edges thereagainst, thus reducing occurrences of edge damage. The first brake member 90 and second brake member 92 are preferably fabricated from rubber, though other materials may be utilized as an alternative. Additionally, the axle members 68, right insert 62, left insert 64 and central inserts 46 are all preferably fabricated from nylon though delrin or other similar materials may also be utilized. The front wall 26, back wall 28, right side wall 30, left side wall 32 and base member 34 are all fabricated from wood, as are each of the partition members 38.

Referring not to FIGS. 3 and 4, attached to the inner surfaces of the right side wall 30 and left side wall 32, as well as the opposed planar surfaces of each of the partition members 38, are generally planer liner members 94. The liner members 94 are attached to the right and left side walls and partition members so as to be disposed within and line each of compartments 40 defined by the housing 24. In the preferred embodiment, each of the compartments 40 includes four liner members disposed therein, i.e. two on opposed sides of the front portion thereof and two on opposed sides of the rear portion thereof. The liner members 94 are adapted to further aid in preventing damage to the edges of the slat material disposed upon the stack rolls 22 by cushioning any contact of the slat material against the side walls 30, 32 or partition members 38 when the stock rolls 22 are being rotated within the compartments 40. In the preferred embodiment, the liner members 94 comprise sheets fabricated from nylon or a similar material.

As previously specified, the front wall 26 of the housing 24 is preferably fabricated having a height significantly less than the height of the back wall 28 of the housing 24. Particularly, the front wall is sized such that the top edge 96 thereof is oriented below the right insert 62, left insert 64 and central inserts 46. As can be appreciated, the front wall 26 is sized in this manner so as not to interfere with the paying out of slat material from the stock rolls 22. As will be recognized, the slat box 20 may be configured to accomodate only one stock roll 22 by not including any partition members 38 disposed between the front wall 26 and back wall 28. In this respect the axle member 68 of the stock roll 22 will be connected to and extend between the right insert 62 and left insert 64.

Additional modifications and improvements of the present invention may also be apparent to those skilled in the art. Thus, the particular combination of parts described and illustrated herein is intended to represent only one embodiment of the invention, and is not intended to serve as limitations as alternative devices within the spirit and scope of the invention.

What is claimed is:

1. A slat box for holding at least one slat stock roll during the fabrication of metal window blinds, comprising:

a housing having a front wall, a back wall, a right side wall and a left side wall;

at least one partition member disposed within said housing and extending between said front wall and said back wall in a manner forming first and second adjacent compartments within said housing, each of said compartments being sized and configured to receive a stock roll;

a right insert attached to said right side wall;

a left insert attached to said left side wall; and a central insert attached to said partition member, said right, left and central inserts being horizontally aligned within the housing;

wherein a first stock roll is received into said first compartment and rotatably interfaced to said right and central inserts with a second stock roll being received into said second compartment and rotatabley interfaced to said left and central inserts.

2. The device of claim 1 wherein said right side wall, said left side wall and said partition member are identically configured and include notches defining opposed vertical edges disposed therein for slideably receiving respective one of said inserts.

3. The device of claim 2 wherein of each of said stock rolls includes an axle member inserted thereinto for facilitating the connection of the stock roll to a respective pair of inserts.

4. The device of claim 3 wherein said right and left sidewall inserts are identically configured and define a pair of vertically oriented slots sized and configured to slidably receive the opposed vertical edges of the notches disposed in said right and left sidewalls, and a recess sized and configured to rotatably receive one end of a respective one of said axle members.

5. The device of claim 4 wherein said central insert defines a pair of vertically oriented slots sized and configured to slideably receive the opposed vertical edges of the notch disposed in said partition member, and a pair of recesses sized and configured to rotatably receive the ends of the axle members opposite those connected to said right and left inserts.

6. The device of claim 5 wherein of each of said axle members has a generally cylindrical configuration and defines first and second ends for receipt into the recesses of the respective pair of inserts, said first end including a annular shoulder formed thereabout.

7. The device of claim 6 further comprising a first brake member disposed about said first end between said shoulder and said stock roll and a second brake member disposed about said second end between said stock roll and the insert into which said second end is inserted.

8. The device of claim 7 wherein said first and second brake members are fabricated from rubber.

9. The device of claim 7 wherein each of the recesses formed in said right, left and central inserts is sized and configured to accommodate said shoulder.

10. The device of claim 5 wherein said right, left and central inserts and said axle members include apertures extending therethrough which are in substantial axial alignment when said inserts are received into said notches and said axle members connected to said inserts, said coaxially aligned apertures being sized to receive an elongate rod member.

11. The device of claim 10 wherein the opposed ends of said rod member are adapted to be securable to said right and left inserts.

12. The device of claim 5 wherein said slat box comprises a plurality of partition members disposed therein defining a plurality of interior compartments for receiving a plurality of stock rolls, each of said partition members including a central insert attached thereto.

13. The device of claim 12 wherein said housing and said partition members are fabricated from wood.

14. The device of claim 5 wherein said inserts and said axle members are fabricated from nylon.

15. The device of claim further comprising a plurality of liner members attached to said right and left sidewalls and said partition member so as to be disposed within and line said first and second compartments, said liner members being adapted to cushion any contact between said stock rolls and said right and left sidewalls and said partition member when said stock rolls are rotated within said first and second compartments.

16. The device of claim 15 wherein said liner members comprise nylon sheets.

17. The device of claim 1 wherein said front wall of said housing defines a top edge and is formed having a height wherein the top edge is oriented below the right, left and central inserts so as not to interfere with the paying-out of material from the stock rolls.

18. The device of claim 17 wherein the back wall of the housing defines a top edge and is formed having a height such that said top edge is oriented above the inserts.

19. The device of claim wherein said housing includes roller casters attached thereto.

20. The device of claim 12, wherein said slat box includes three partition members disposed therein defining four interior compartments.

* * * * *